US007437103B2

(12) United States Patent
Maeshima et al.

(10) Patent No.: US 7,437,103 B2
(45) Date of Patent: Oct. 14, 2008

(54) IMAGING APPARATUS

(75) Inventors: Masanobu Maeshima, Osaka (JP); Taisuke Nagao, Osaka (JP); Yoshihiro Yamagishi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/604,718

(22) Filed: Nov. 28, 2006

(65) Prior Publication Data

US 2007/0122200 A1 May 31, 2007

(30) Foreign Application Priority Data

Nov. 29, 2005 (JP) ..... 2005-344120

(51) Int. Cl.
*G03G 15/01* (2006.01)

(52) U.S. Cl. ..... 399/227; 399/99; 399/261

(58) Field of Classification Search ..... 399/358–360, 399/261, 254, 227, 101, 99
See application file for complete search history.

(56) References Cited

U.S. PATENT DOCUMENTS 5,799,228 A * 8/1998 Iwata et al. ..... 399/94
6,324,354 B1 * 11/2001 Tode et al. ..... 399/29
7,088,930 B2 * 8/2006 Mimura ..... 399/27
7,242,872 B2 * 7/2007 Okamoto et al. ..... 399/12
7,242,878 B2 * 7/2007 Kojima et al. ..... 399/27
7,248,822 B2 * 7/2007 Yokota et al. ..... 399/226
2002/0118976 A1 * 8/2002 Fischer ..... 399/49
2005/0123320 A1 * 6/2005 Okamoto et al. ..... 399/119
2005/0214000 A1 * 9/2005 Kojima et al. ..... 399/27
2005/0281580 A1 * 12/2005 Lewis et al. ..... 399/109
2006/0210314 A1 * 9/2006 Yamada et al. ..... 399/227

FOREIGN PATENT DOCUMENTS

JP 2000-330379 11/2000

* cited by examiner

*Primary Examiner*—David M. Gray
*Assistant Examiner*—Kristofferson Service
(74) *Attorney, Agent, or Firm*—Global IP Counselors, LLP

(57) ABSTRACT

An imaging apparatus includes a toner ejection mode whereby toner stored in a black developing container is completely removed from the developing container by rotating a rotary developing unit at a specific timing and using gravity and the centrifugal force that acts on the toner stored in the black developing container due to this rotation, or using the vibration that acts on the black developing container when the rotation is stopped. In this toner ejection mode, the toner is ejected from the developing container of the rotary developing unit, an image for a single sheet of recording paper is formed on the surface of a photoreceptor drum, and the toner constituting the image transferred onto the surface of an intermediate transfer belt by the photoreceptor drum is then recovered by a belt-cleaning unit.

14 Claims, 6 Drawing Sheets

IMAGING APPARATUS

CROSS-REFERENCE TO RELATED APPLICATIONS

This application claims priority to Japanese Patent Application No. 2005-344120 filed on Nov. 29, 2005. The entire disclosure of Japanese Patent Application No. 2005-344120 is hereby incorporated herein by reference.

BACKGROUND OF THE INVENTION

1. Field of the Invention

The present invention relates to an imaging apparatus. More specifically, the present invention relates to an imaging apparatus such as a copier or a printer, and particularly relates to an apparatus capable of outputting color images.

2. Background Information

Copiers, printers, and other such imaging apparatuses are known in conventional practice. These imaging apparatuses are provided with a developer unit that performs developing by allowing toner to adhere to an electrostatic latent image formed on the surface of a photoreceptor drum. The toner is stored inside the developer unit, and the developer unit includes a stirring roller for stirring the toner, and a developing roller or the like for supplying the toner to the surface of the photoreceptor drum.

After an imaging apparatus having this type of configuration is manufactured in a factory, the imaging apparatus takes on one of the following three primary aspects during the shipping stage. Specifically, the three aspects are as follows: the toner is not stored in the developing unit and an image check is not made; the developing unit is removed from the imaging apparatus after toner is loaded into the developing unit and an image check is made, and the developing unit is mounted on the imaging apparatus after the developing unit is cleaned by blowing air through the inside of the developing unit; or the toner is stored in the developing unit and an image check is made, but the developing unit is not cleaned.

When a nonmagnetic toner component is stored in the developing unit, selective developing takes place in which small toner particles are preferentially consumed as specified small toner particles, and large toner particles accumulate in small portions inside the developing unit as more and more pages are printed. Consequently, the particle size distribution of the toner stored inside the developing unit changes every time the toner is newly replenished. In this developing unit, when the toner is stirred by the stirring roller, contact among the toner particles causes stress within the toner, and external toner additives are shed from the toner surface and are incorporated into the toner.

These changes in the particle size distribution of the toner stored in the developing unit, as well as toner degradation due to contact among the toner particles cause concentration reduction and surface fogging in the images printed on the recording paper, resulting in the reduced quality of the images. In particular, the problems resulting from changes in the particle size distribution of the toner or degradation of the toner occur more rapidly with a reduction in the toner storage capacity of the developing unit. To maintain the quality of the images printed on the recording paper, a refreshing operation is performed at a specific timing interval. In this operation, old toner stored in the developing unit is replaced with new toner.

One proposed example of an apparatus in which the developing unit is refreshed is an imaging apparatus in which the toner is formed into a uniformly thin film by charging to maintain a constant particle distribution in the toner on the surface of the developer sleeve, and in which image concentration reduction, surface fogging, and other image problems are prevented. This is accomplished by a method in which an alternating-current electric field is applied between the photoreceptor drum and a developer sleeve for conveying toner to the developing area on the photoreceptor drum, and the toner remaining on the surface of the developer sleeve is scattered over the photoreceptor drum to refresh the developer sleeve when the average printing density for a standard number of printings falls below a specific value (see Japanese Laid-open Patent Application No. 2000-330379).

However, problems are encountered in that an image check cannot be made in cases in which the apparatus is designed so that the toner is not stored in the developing unit and an image check is not made when shipped from the manufacturing plant. Furthermore, not only is time needed to attach and remove a developing unit, but there is also the possibility of assembly errors caused while the developing unit is attached or removed in cases in which the apparatus is designed so that the developing unit is removed from the imaging apparatus after toner is stored in the developing unit and an image check is made, and the developing unit is mounted in the imaging apparatus after the developing unit is cleaned by blowing air through the inside of the developing unit. The frequency of assembly errors increases particularly when the configuration of the imaging apparatus becomes more complicated as the apparatus is reduced in size.

Furthermore, there is a possibility that condensation will adhere in the toner remaining inside the developing unit due to variation in the outside temperature, or that the toner remaining inside the developing unit will scatter to the outside of the developing unit due to vibrations while the imaging apparatus is being transported in cases in which the apparatus is designed so that toner is stored in the developing unit and an image check is made, but the developing unit is not cleaned. Consequently, the imaging apparatus is preferably shipped after toner is stored in the developing unit, an image check is made, and the toner is completely removed from the developing unit while the developing unit remains mounted in the imaging apparatus.

The toner disposed closer to the stirring roller in the portion where the toner is stored in the developing unit is stirred in the circumferential direction, while toner farther from the stirring roller is pushed towards the inner wall of the developing unit when information is printed on recording paper. Specifically, a phenomenon occurs wherein toner closer to the stirring roller flows through the inside of a tunnel formed as a result of the fact that the toner farther from the stirring roller is pushed towards the inner wall of the developing unit. In cases in which the developing unit is provided with a conveying spiral for causing the toner to adhere uniformly to the surface of the developing roller by conveying the toner in the axial direction of the developing roller, the toner conveyed in a constant direction by the rotation of the conveying spiral is pushed towards the inner wall of the developing unit.

The pushing of the toner towards the inner wall of the developing unit causes the toner to enter the dead space in the portion where the toner is stored in the developing unit, and the toner remains in this dead space. The term "dead space" refers to a location in the portion where toner is stored in the developing unit and where the toner is not supplied to the photoreceptor drum. Consequently, old toner cannot be completely removed from the developing unit even though an operation is performed to remove the toner from the developing unit after the toner is stored in the developing unit and an image check is made during shipping of the imaging apparatus from the manufacturing plant.

Also, old toner cannot be completely removed from the developing unit even if a refreshing operation is performed to replace the old toner in the developing unit with new toner at a specific timing interval as described above. Therefore, the new toner is mixed with the old toner in the developing unit after the refreshing operation, and the image quality reduction that accompanies toner degradation due to changes in the toner particle size distribution or due to contact among the toner particles is manifested at an earlier stage than when new toner is stored in the developing unit. Consequently, the intervals between refreshing operations intended to prevent reduction in image quality grow shorter as printing continues, leading to problems related to the reduced service life of the toner stored inside the developing unit.

In view of the above, it will be apparent to those skilled in the art from this disclosure that there exists a need for an improved imaging apparatus. This invention addresses this need in the art as well as other needs, which will become apparent to those skilled in the art from this disclosure.

SUMMARY OF THE INVENTION

The present invention was designed in view of these circumstances, and an object thereof is to provide an image forming apparatus wherein the operation of attaching and removing a developing unit following an image check can be omitted and the service life of toner can be increased by completely removing the toner from the developing unit.

To achieve this object, the imaging apparatus of the present invention includes a photoreceptor drum capable of supporting electrostatic latent images; a plurality of developing containers that stores a toner in the interior and that is capable of developing the electrostatic latent images by supplying the toner onto the photoreceptor drum; a rotating unit that can place the developing containers in positions facing a photoreceptor drum by holding and rotating the developing containers; and a toner ejection mode to supply the toner inside from at least one of the developing containers to the surface of the image or toner support at a position facing the photoreceptor drum while images are not being formed, and causing the rotating unit to rotate with a specific timing.

In this imaging apparatus, rotating the rotating image unit in the toner ejection mode makes it possible to use gravity and centrifugal force acting on the toner stored in the developing containers or to use the vibrations acting on the developers when the rotating image unit stops rotating, and to remove completely the toner remaining in the dead space of the developing containers. Consequently, the operation of attaching and removing the rotary developing unit following an image check can be omitted when the imaging apparatus is shipped, and the service life of the toner stored in the developing containers can be increased.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
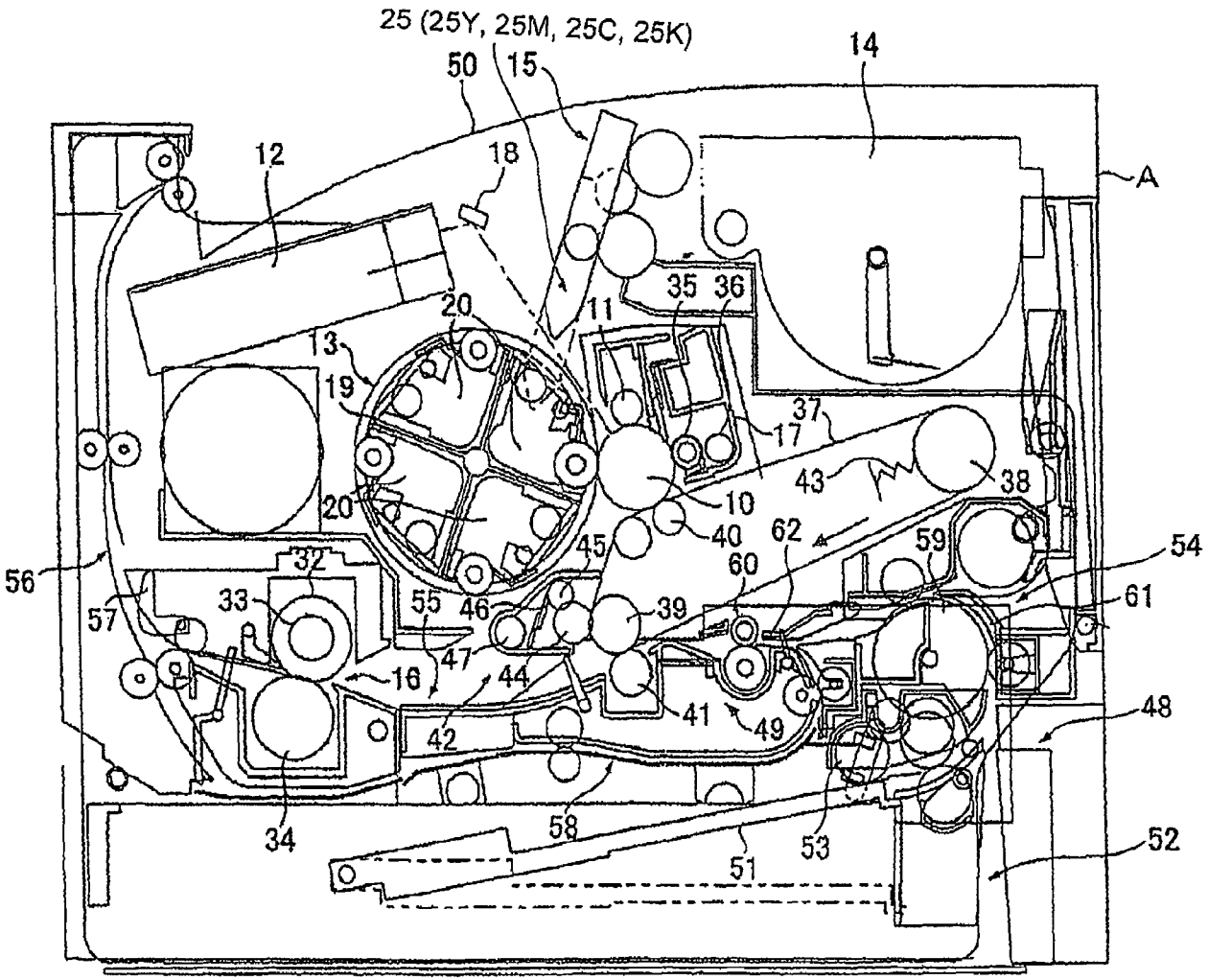
FIG. 1 is a cross-sectioned diagrammatic view showing the structure of a printer according to a preferred embodiment of the present invention.

Referring initially to FIG. 1, the imaging apparatus of the present embodiment can be connected to a single terminal device or multiple terminal devices (not shown) via a LAN (local area network), the Internet, or another such communication network. This imaging apparatus has a printer function to output color images or monochrome images on the basis of image data sent from the terminal devices, and is used as the printer A shown in FIG. 1. The printer A has a one-sided printing mode to print images on one side of recording paper, and a two-sided printing mode to print images on both sides of the recording paper. In the printer A shown in FIG. 1, the right side of the drawing corresponds to the front side of the printer A, and the left side of the drawing corresponds to the rear side of the printer A.

The printer A includes a photoreceptor drum 10 wherein electrostatic latent images are formed on the surface, a charging roller 11 to charge uniformly the entire surface of the photoreceptor drum 10, a light exposure unit 12 to irradiate the surface of the photoreceptor drum 10 with laser light, a rotary developing unit 13 to develop images by allowing toner to adhere to the electrostatic latent images formed on the surface of the photoreceptor drum 10, a toner storage part 14 to store toner to be supplied to the rotary developing unit 13, a toner supply unit 15 to supply the toner stored in the toner storage part 14 to the rotary developing unit 13, a fixing unit 16 to fix the transferred toner onto the recording paper, and a drum-cleaning unit 17 to remove the remaining toner and other deposits from the surface of the photoreceptor drum 10, as shown in FIG. 1.

In the printer A thus configured, the photoreceptor drum 10 is rotatably mounted inside the printer A in the vicinity of the center, and the rotational axis thereof extends in a direction horizontal relative to the mounting surface; i.e., in a direction perpendicular to the surface of the drawing, when viewed from the front side of the printer A, as shown in FIG. 1. The surface of the photoreceptor drum 10 is preferably formed from amorphous silicon (a-Si).

The charging roller 11 is mounted above the photoreceptor drum 10, at a position proximal to the photoreceptor drum 10, as shown in FIG. 1. When a specific high voltage is applied to the charging roller 11, the surface of the photoreceptor drum 10 is uniformly charged by the electric discharge of the charging roller 11.

In the light exposure unit 12, laser light from a semiconductor laser (not shown) is directed towards the photoreceptor drum 10, on the basis of image data that has been sent from the terminal devices connected to the printer A. The light exposure unit 12 is mounted above the photoreceptor drum 10 on the reverse side of the rotational axis of the rotary developing unit 13, as shown in FIG. 1. A reflective mirror 18 is also mounted in the optical path of the laser light that reaches the photoreceptor drum 10 from the light exposure unit 12, as shown in FIG. 1. As shown by the single-dashed line in FIG. 1, the laser light emitted by the light exposure unit 12 is reflected at a specific angle by the reflective mirror 18 and directed towards the photoreceptor drum 10, whereby an electrostatic latent image is formed on the portion of the photoreceptor drum 10 struck by the laser light.

A unit that directs laser light emitted by a large number of LEDs (not shown) arrayed in linear fashion on an LED head (not shown) onto the surface of the photoreceptor drum 10 may be used as the light exposure unit 12, instead of a unit that directs laser light emitted from a semiconductor laser such as is described above onto the surface of the photoreceptor drum 10.

Figure 2:
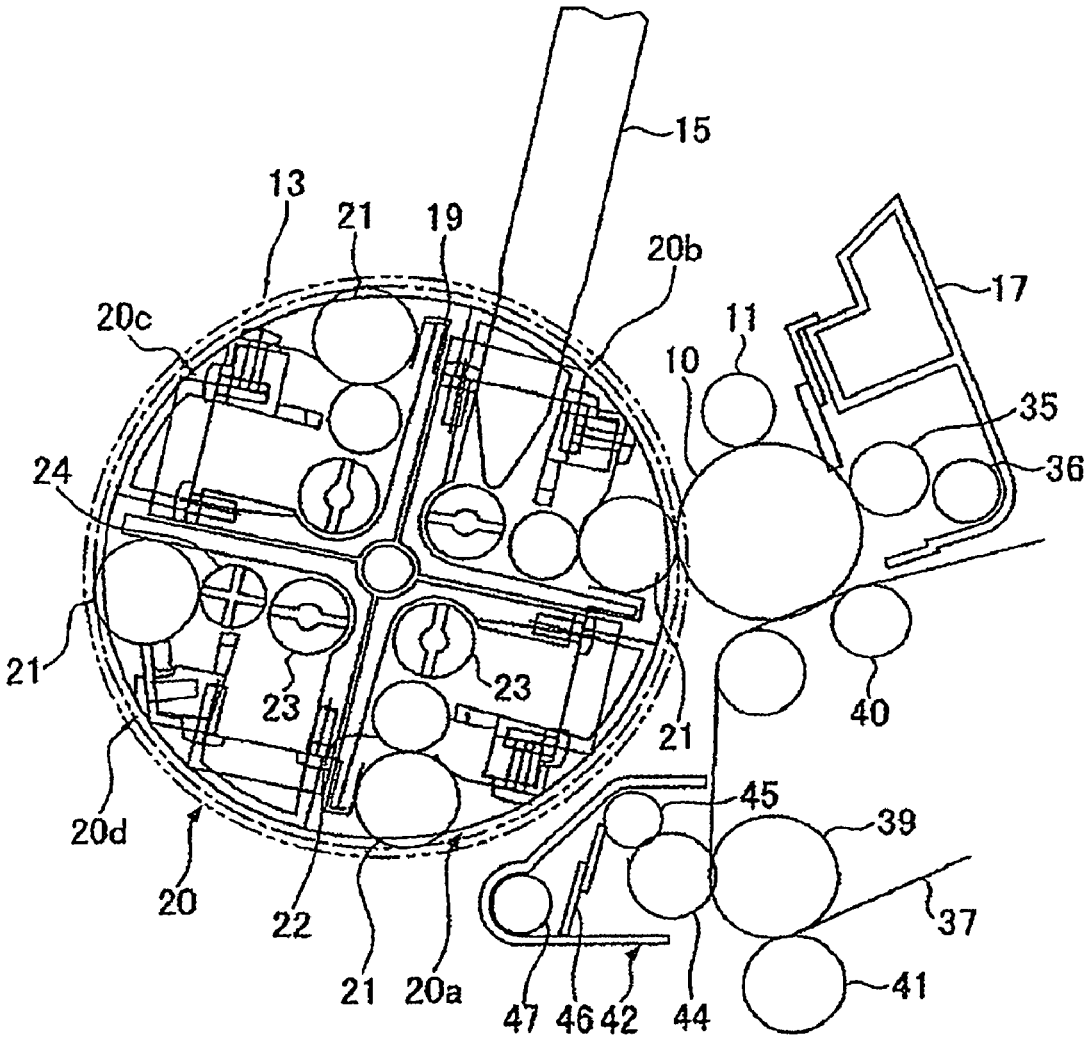
FIG. 2 is an enlarged cross-sectional diagrammatic view showing the structure of a peripheral area of a rotary developing unit and a photoreceptor drum in the printer of FIG. 1.

The rotary developing unit 13 is preferably formed in the shape of a cylinder, and is mounted on the reverse side of the photoreceptor drum 10 and adjacent to the photoreceptor drum 10 as shown in FIG. 1. The rotary developing unit 13 includes a rotating frame (an example of a rotating unit) 19 that extends in a radial pattern from the rotational axis at 90° intervals in the circumferential direction, and four developing containers 20 that are supported on the rotating frame 19 and that store toners of cyan (C), magenta (M), yellow (Y), and black (K), as shown in FIG. 2. The rotating frame 19 is formed to be capable of rotating around an axis parallel to the rotational axis of the photoreceptor drum 10, and is driven by a drive mechanism (not shown) composed of a motor and gears. The developing containers 20 are disposed in four compartments that are divided into four equal parts by the rotating frame 19 in the circumferential direction of the rotary developing unit 13.

Assuming that the four developing containers 20 are arranged as a cyan developing container 20*a*, a magenta developing container 20*b*, a yellow developing container 20*c*, and a black developing container 20*d* according to the colors of the toner stored in the developing containers 20 as shown in FIG. 2, a single nonmagnetic toner component is preferably and respectively stored in the cyan developing container 20*a*, the magenta developing container 20*b*, and the yellow developing container 20*c*. A single toner component is also stored in the black developing container 20*d*. Consequently, the internal configuration of the black developing container 20*d* differs from that of the cyan developing container 20*a*, the magenta developing container 20*b*, and the yellow developing container 20*c*.

Specifically, the cyan developing container 20*a*, the magenta developing container 20*b*, and the yellow developing container 20*c* each include a developing roller 21 to supply toner to the photoreceptor drum 10, a sponge roller 22 that is in contact with the developing roller 21 and that causes the toner to adhere to the surface of the developing roller 21, and a stirring roller 23 to stir the toner stored inside the developing containers 20*a*, 20*b*, and 20*c*, as shown in FIG. 2. The developing containers 20*a*, 20*b*, and 20*c* are configured to supply toner to the developing rollers 21 from the sponge rollers 22, and the toner is prevented from being directly supplied to the developing rollers 21 from the portions in the developing containers 20*a*, 20*b*, and 20*c* where the toner is stored.

In addition to a developing roller 21 and a stirring roller 23 described above, the black developing container 20*d* also includes a conveying spiral 24 to cause the toner to adhere uniformly to the surface of the developing roller 21 by conveying the toner in the axial direction of the developing roller 21. The black developing container 20*d* is configured to supply the toner to the developing roller 21 by way of the conveying spiral 24, and it is possible for the toner to be directly supplied to the developing roller 21 from the portion in the developing container 20*d* where the toner is stored.

When the cyan developing container 20*a*, the magenta developing container 20*b*, the yellow developing container 20*c*, and the black developing container 20*d* are configured in this manner, images are developed by rotating the rotary developing unit 13 and causing the toner stored in the developing containers 20 to adhere to the electrostatic latent image formed on the surface of the photoreceptor drum 10.

As shown in FIG. 1, the toner storage part 14 is a portion to store all four colors of the toner supplied to the developing containers 20 of the rotary developing unit 13, and is mounted farthest to the front side in the printer A. Four toner cartridges (not shown) for the corresponding toner colors are preferably mounted in the toner storage part 14. These cartridges are aligned in a direction parallel to the mounting surface, i.e., in a direction perpendicular to the surface of the drawing, when viewed from the front side of the printer A. The four toner cartridges can be taken out through the front side of the printer A.

Figure 3:
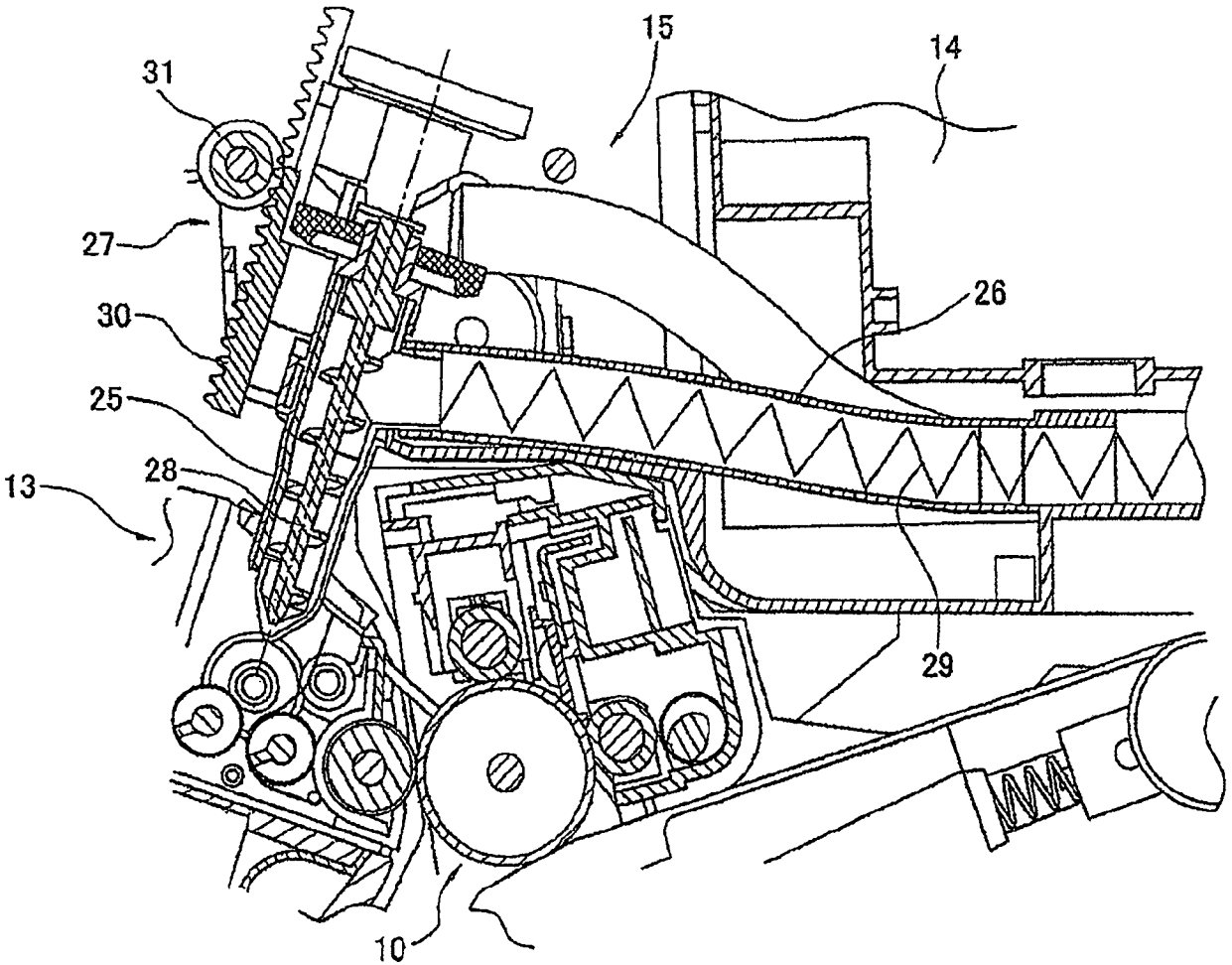
FIG. 3 is an enlarged cross-sectional diagrammatic view showing the structure of a peripheral area of a toner supply unit in the printer of FIG. 1.

The toner supply unit 15 supplies the four toner colors stored in the toner cartridges of the toner storage part 14 to the developing containers 20 that correspond to each toner color. The toner supply unit 15 is preferably mounted in a space located above the rotary developing unit 13 and between the light exposure unit 12 and the toner storage part 14, as shown in FIG. 1. Referring to FIGS. 1 and 3, the toner supply unit 15 preferably includes four toner supply pipes 25 (25Y, 25M, 25C, and 25K) that correspond to each of the four toner colors and that are capable of moving vertically, four conveying pipes 26 to connect the four toner cartridges mounted on the toner storage part 14 with the toner supply pipes 25 that correspond to the toner colors stored in the toner cartridges, and drive mechanisms 27 to move the toner supply pipes 25 vertically.

Figure 6:
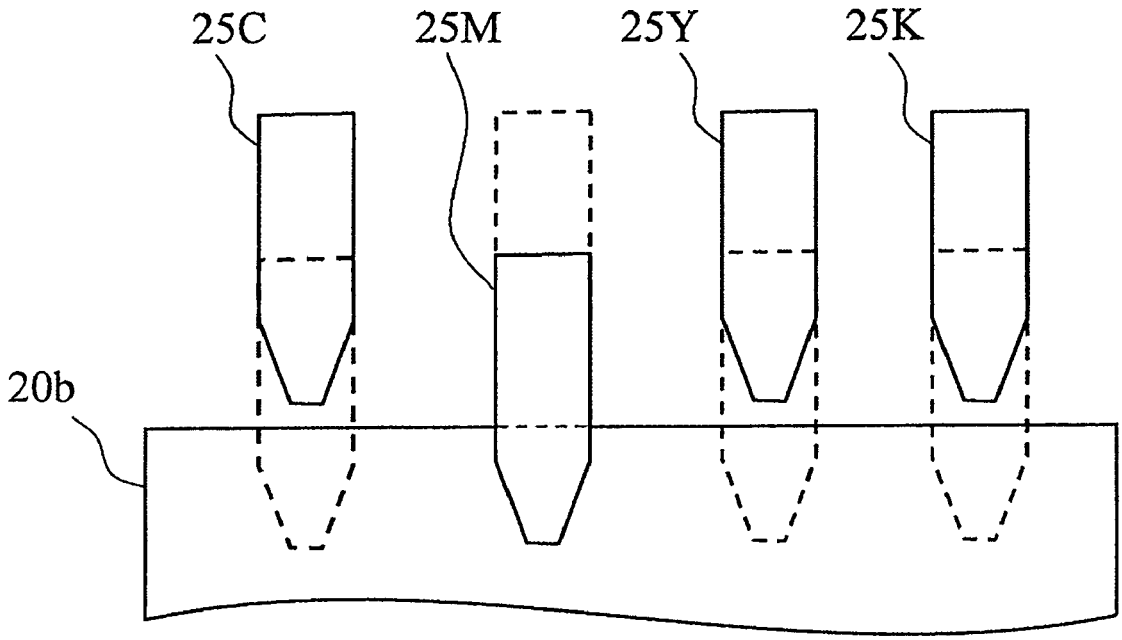
FIG. 6 is an enlarged cross-sectional diagrammatic view showing the structure of toner supply pipes and a magenta developing container in the printer of FIG. 1.

As shown in FIGS. 3 and 6, in the toner supply unit 15 thus configured, the toner supply pipes 25 extend vertically and are tapered at the bottom ends. Spiral members 28 to convey toner towards the bottom ends of the toner supply pipes 25 are rotatably attached inside the toner supply pipes 25. When the toner supply pipes 25 move to the supply positions shown by the dashed lines in FIG. 1, the bottom ends of the toner supply pipes 25 move into the developing containers 20 through slits (not shown) formed in the developing containers 20, and the toner is supplied to the developing containers 20 by the toner supply pipes 25.

Referring again to FIG. 3, the conveying pipes 26 extend to the left and right; i.e., in a direction that connects the front side of the printer A with the reverse side. These pipes are sufficiently flexible to allow themselves to be moved by the vertical movement of the toner supply pipes 25. Coil springs 29 are rotatably attached to the insides of the conveying pipes 26. Toner is conveyed through the insides of the conveying pipes 26 to the toner supply pipes 25 when the coil springs 29 rotate.

Each drive mechanism 27 also includes a rack 30 that extends parallel to the axial direction of the toner supply pipe 25 and that is attached to the outer periphery of the toner supply pipe 25, and a pinion gear 31 meshed with the rack 30, as shown in FIG. 3. The pinion gear 31 is rotatably supported on the frame (not shown) of the printer A, and is driven by a motor (not shown) or the like. Referring to FIGS. 1 and 3, when the motor is driven, the pinion gear 31 rotates, and the toner supply pipe 25 to which the rack 30 meshed with the pinion gear 31 is attached moves vertically between a retracted position shown by the solid lines in FIG. 1 and a supply position shown by the dashed lines in FIG. 1.

When the toner supply pipes 25 are in the supply positions shown by the dashed lines in FIG. 1; i.e., when toner is supplied to the developing containers 20 of the rotary developing unit 13, the optical path is blocked for the laser light emitted from the light exposure unit 12 towards the photoreceptor drum 10, as shown by the single dashed line in FIG. 1. In this printer A, laser light is emitted from the light exposure unit 12 when the toner supply pipes 25 are in the retracted positions shown by the solid lines in FIG. 1; i.e., when toner is not being supplied to the developing containers 20.

The fixing unit 16 includes a fixing roller 32 formed into a cylinder, a fixation heater 33 mounted inside the fixing roller 32 and designed to heat the fixing roller 32, and a pressure roller 34 that presses against the fixing roller 32, as shown in FIG. 1. A nipping part to hold the recording paper is formed between the fixing roller 32 and the pressure roller 34. When the recording paper passes through the nipping part between the fixing roller 32 and the pressure roller 34, the toner adhered to the recording paper is melted by the heat from the fixing roller 32, and pressure is applied to the recording paper by the pressure roller 34, fixing the toner on the recording paper.

The drum-cleaning unit 17 is mounted on the front side of the photoreceptor drum 10 and adjacent to the photoreceptor drum 10, and also above an intermediate transfer panel 37 described later. The drum-cleaning unit 17 includes a polishing roller 35 as a drum-cleaning member that comes into contact with the photoreceptor drum 10, and a recovery spiral 36 to convey part of the surface of the photoreceptor drum 10 polished by the polishing roller 35 and to convey the toner deposit remaining on the surface of the photoreceptor drum 10. A recovery unit (not shown) to recover the deposit conveyed by the recovery spiral 36 in a direction perpendicular to the surface of the drawing in FIG. 1 is mounted on the reverse side of the recovery spiral 36 in a direction perpendicular to the surface of the drawing in FIG. 1.

After the toner adhered to the surface of the photoreceptor drum 10 is transferred to the intermediate transfer panel 37 during the printing operation, the deposit on the photoreceptor drum 10 is scraped off by polishing the surface of the photoreceptor drum 10 with the polishing roller 35. The deposit on the photoreceptor drum 10 scraped off by the polishing roller 35 is conveyed by the recovery spiral 36 in a direction perpendicular to the surface of the drawing in FIG. 1, and is recovered in the recovery unit.

As shown in FIG. 1, the printer A includes the intermediate transfer panel 37 on which images that correspond to each toner and are formed on the surface of the photoreceptor drum 10 are superposed and transferred, a driven roller 38 and drive roller 39 that are in contact with the back surface of the intermediate transfer panel 37 (the surface on the opposite side of which images are transferred) and that move the intermediate transfer panel 37 in the direction of the arrow in FIG. 1, a primary transfer roller 40 that presses against the photoreceptor drum 10 via the intermediate transfer panel 37 and is designed to transfer the images formed on the surface of the photoreceptor drum 10 onto the surface of the intermediate transfer panel 37, a secondary transfer roller 41 that presses against the drive roller 39 via the intermediate transfer panel 37 and is designed to transfer the images formed on the surface of the intermediate transfer panel 37 onto the recording paper, and a belt-cleaning unit 42 to remove the toner deposit remaining on the surface of the intermediate transfer panel 37.

In the printer A thus configured, the intermediate transfer panel 37 is mounted below the photoreceptor drum 10 and the toner storage part 14 as shown in FIG. 1, and spans the distance between the driven roller 38 and the drive roller 39 that are in contact with the reverse surface of the intermediate transfer panel 37. Also, the primary transfer roller 40 is mounted below the photoreceptor drum 10, in a part that faces the photoreceptor drum 10 via the intermediate transfer panel 37, and the primary transfer roller 40 is pressed against the photoreceptor drum 10, as shown in FIG. 1. The driven roller 38 is urged away from the drive roller 39 by the spring 43 shown in FIG. 1, and the pressure of the spring 43 applies a specific tensile force to the intermediate transfer panel 37.

The secondary transfer roller 41 is mounted below the drive roller 39 at a position that faces the drive roller 39 via the intermediate transfer panel 37, and is pressed against the intermediate transfer panel 37, as shown in FIG. 1. During the printing operation, images formed on the surface of the intermediate transfer panel 37 are transferred to the recording paper when the recording paper passes through the nipping part formed between the drive roller 39 and the secondary transfer roller 41.

The belt-cleaning unit 42 is mounted adjacent to the drive roller 39 on the reverse side of the drive roller 39 and below the rotary developing unit 13, as shown in FIGS. 1 and 2. The belt-cleaning unit 42 includes a brush roller 44 as a belt-cleaning member that is mounted at a position facing the drive roller 39 via the intermediate transfer panel 37 and that is in contact with the intermediate transfer panel 37, a cleaning roller 45 that is mounted above the brush roller 44 to be in contact with the brush roller 44, a blade 46 that is mounted so that the top end thereof is in contact with the surface of the cleaning roller 45, and a recovery spiral 47 that is mounted below the blade 46 at the left end of the interior of the belt-cleaning unit 42. A recovery unit (not shown) to recover the deposit conveyed by the recovery spiral 47 in a direction perpendicular to the surface of the drawing in FIG. 1 is mounted on the reverse side of the recovery spiral 47 in a direction perpendicular to the surface of the drawing in FIG. 1.

During the printing operation, the recording paper passes through the nipping part between the drive roller 39 and the secondary transfer roller 41, causing the images formed on the surface of the intermediate transfer panel 37 to be transferred to the recording paper, and the toner deposit remaining on the surface of the intermediate transfer panel 37 is then scraped off by the brush roller 44 of the belt-cleaning unit 42 and is made to adhere to the surface of the cleaning roller 45. The deposit from the intermediate transfer panel 37 that has adhered to the surface of the cleaning roller 45 is scraped off the surface of the cleaning roller 45 by the blade 46, and is then conveyed by the recovery spiral 47 in a direction perpendicular to the surface of the drawing in FIG. 1 and is recovered in the recovery unit.

The printer A also includes a paper supply unit 48 that is configured to be capable of storing multiple sheets of recording paper and that supplies the recording paper one sheet at a time, a conveyance unit 49 to convey the recording paper supplied by the paper supply unit 48 into the printer A, and a paper ejection unit 50 to eject the recording paper having images printed thereon while the paper is being conveyed by the conveyance unit 49, as shown in FIG. 1.

In the printer A thus configured, the paper supply unit 48 includes a paper supply cassette 52 provided with a lift plate 51 and used to carry multiple sheets of recording paper, and a paper supply roller 53 that comes into contact with the recording paper disposed on the lift plate 51 and feeds the recording paper from the paper supply cassette 52, as shown in FIG. 1. The paper supply cassette 52 can be removed through the front side of the printer A.

The conveyance unit 49 is mounted between the paper supply unit 48 and the paper ejection unit 50, as shown in FIG. 1. The conveyance unit 49 is configured from a first conveyance path 54 running from the paper supply unit 48 to the secondary transfer roller 41, a second conveyance path 55 running from the secondary transfer roller 41 to the fixing unit 16, and a third conveyance path 56 running from the fixing unit 16 to the paper ejection unit 50. A branching pawl 57 is mounted downstream of the fixing unit 16 in the third conveyance path 56, and a return conveyance path 58 is mounted below the second conveyance path 55 and is designed to operate so that recording paper that has passed through the fixing unit 16 is returned to the first conveyance path 54 by means of the branching pawl 57 in the two-sided printing mode.

In the conveyance unit 49 thus configured, guiding plates and roller pairs (neither are shown) to guide and to convey the recording paper are preferably mounted in each of the first through third conveyance paths 54, 55, and 56. The first conveyance path 54 is provided with a pair of resist rollers (paper stop roller) 60 (described below) to correct the orientation of the recording paper that has passed through the conveyance roller 59 and to adjust the timing with which the recording paper is conveyed, and a conveyance roller 59 to convey recording paper supplied from the paper supply cassette 52 to the pair of resist rollers 60, as shown in FIG. 1. The first conveyance path 54 is configured from a curved path 61 formed along the conveyance roller 59, and a straight path 62 running from the curved path 61 to the secondary transfer roller 41.

The second conveyance path 55 is formed in a substantially rectilinear fashion and is extended from the front side of the printer A to the reverse side in a horizontal direction in relation to the mounting surface of the printer A, as shown in FIG. 1. The third conveyance path 56 is formed so that the portion running from the fixing unit 16 to the branching pawl 57 is mostly straight, and the third conveyance path extends from the front side of the printer A to the reverse side in a horizontal direction in relation to the mounting surface of the printer A, as shown in FIG. 1. The portion of the third conveyance path running from the branching pawl 57 to the paper ejection unit 50 extends towards the top of the printer A in a direction perpendicular to the mounting surface of the printer A.

Furthermore, the return conveyance path 58 diverges downward from the portion of the third conveyance path 56 in which the branching pawl 57 is mounted, and extends below the fixing unit 16, the second conveyance path 55, and the secondary transfer roller 41. The return conveyance path extends from the reverse side of the printer A to the front side in a direction horizontal in relation to the mounting surface of the printer A, as shown in FIG. 1. The return conveyance path 58 is connected to the immediate upstream side of the resist rollers 60 in the straight path 62 of the first conveyance path 54. A guide plate and a pair of rollers (neither are shown) to guide and conveying recording paper are mounted in the return conveyance path 58 in the same ore similar manner as in the first through third conveyance paths 54, 55, and 56.

The paper ejection unit 50 is formed on the top surface outside of the printer A, as shown in FIG. 1. Recording paper that has passed through the fixing unit 16 is fed to the outside of the printer A through the third conveyance path 56, and is ejected into the paper ejection unit 50.

Figure 4:
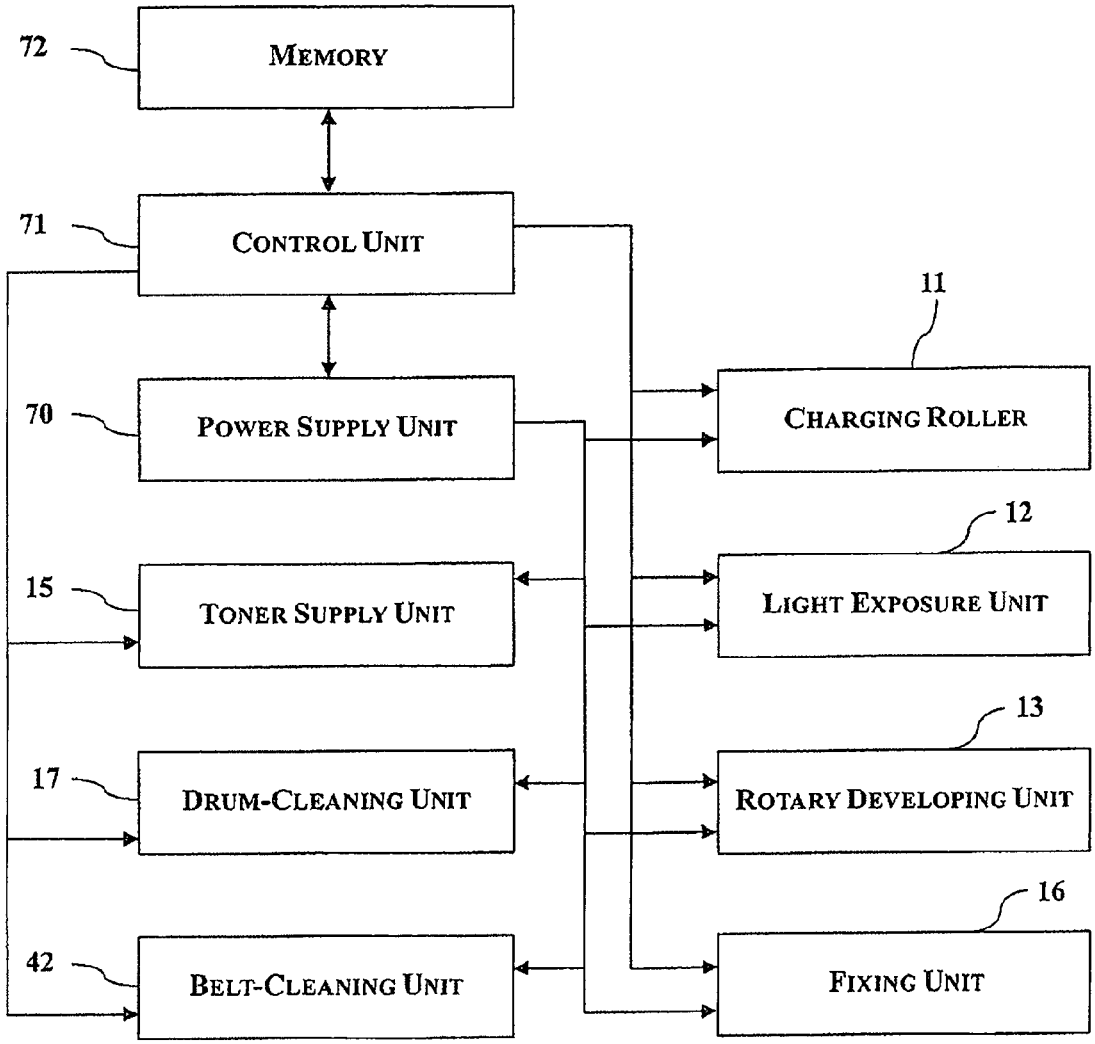
FIG. 4 is a view of a block diagram showing the configuration of part of the printer of FIG. 1.

Furthermore, referring now to FIG. 4, a power supply unit 70 is mounted in the printer A to supply power to all the units, including the light exposure unit 12, the toner supply unit 15, the fixing unit 16, the drum-cleaning unit 17, and the belt-cleaning unit 42. Power is also supplied to a motor (not shown) to rotate the photoreceptor drum 10, the rotary developing unit 13, and all of the rollers that include the charging roller 11, the drive roller 39, the primary transfer roller 40, the secondary transfer roller 41, and the resist rollers 60, as shown in FIG. 4. The printer is also provided with a control unit 71 to control the power supply unit 70 and the aforementioned units and motor supplied with power from the power supply unit 70, and memory 72 to store data and a control program executed by the control unit 71.

The control unit 71 includes a counter to count the number of sheets X of recording paper used to print in the toner ejection mode described later, and a counter to count the number of rotations Y made by the rotary developing unit 13 (neither are shown).

In the control unit 71, the number of dots formed by the black toner and calculated by analyzing the image data sent from a terminal device connected to the printer A is counted for each sheet of recording paper, and the dot number is converted into a toner amount. The resulting data on toner consumption are totaled and stored in the memory 72 shown in FIG. 4 for each sheet of recording paper used in the printing process. Consequently, when an image is printed on ten sheets of recording paper, for example, data on the toner consumption for these ten sheets of recording paper are totaled and stored in the memory 72.

Referring to FIG. 1, after a printer A thus configured is manufactured in a factory, a trial printing is performed as an operation check before the printer A is shipped. Toner is stored in the developing containers 20 of the rotary developing unit 13 in order to perform the trial printing at this time. Referring now to FIGS. 1 and 2, after the trial printing is complete, the toner is removed from the black developing container 20*d* in order to prevent the toner from scattering to the outside of the developing container 20*d* as a result of vibration while the printer A is being transported during shipping.

Large toner particles begin to accumulate in small amounts in the black developing container 20*d* due to selective developing as more and more pages of recording paper are printed after the printer A is first used, and the particle size distribution of the toner stored inside the developing container 20*d* changes every time the toner is newly replenished. Furthermore, when the toner in the black developing container 20*d* is stirred by the stirring roller 23 and conveyed by the conveying spiral 24, contact among the toner [particles] causes external toner additives to be shed from the toner surface and to be incorporated into the toner.

To prevent changes in the particle size distribution of the toner stored in the black developing container 20*d*, and to prevent image quality from being adversely affected (resulting in image concentration and surface fogging) by toner degradation, an operation is performed in the printer A to replace the old toner stored in the black developing container 20*d* with new toner at a specific timing interval.

The configurations of the cyan developing container 20*a*, the magenta developing container 20*b*, and the yellow developing container 20*c*, which are containers other than the black developing container 20*d*, are different from that of the black developing container 20*d*. In the containers other than the black developing container, the surface of the developing roller 21 is covered with rubber or another such elastic material, and a blade (not shown) to regulate the thickness of the toner that adheres to the surface of the developing roller 21 is kept in contact with the developing roller 21. Therefore, the toner is readily charged by friction as a result of the contact between the developing roller 21 and the blade. Consequently, it is unlikely that the toner will scatter to the outside of the developing containers 20*a*, 20*b*, and 20*c* because the toner holds a greater electric charge and forms a thinner layer on the surface of the developing roller 21 in these containers.

In the cyan developing container 20*a*, magenta developing container 20*b*, and yellow developing container 20*c*, a small amount of toner must be allowed to adhere to the surface of the developing roller 21 while the manufactured printer A is shipped from the factory. This means that the developing containers 20*a*, 20*b*, and 20*c* containing a single nonmagnetic toner component as described above are configured so that a blade (not shown) is in contact with the developing roller 21. Therefore, when the toner is completely removed from the surface of the developing roller 21, the blade comes into direct contact with the developing roller 21 without the intervening toner, and the surface of the developing roller 21 might be abraded by the friction with the blade when the developing roller 21 rotates.

Consequently, an operation involving the black developing container 20*d* is performed in this printer A to replace the old toner stored in the developing container 20*d* with new toner. However, the toner conveyed in a constant direction by the rotation of the conveying spiral 24 in the black developing container 20*d* is pushed towards the inner wall of the black developing container 20*d* during the printing operation. When the toner is conveyed in the circumferential direction of the stirring roller 23 and the conveying spiral 24 by the rotation of these members, the toner in the vicinity of the stirring roller 23 and the conveying spiral 24 moves in the circumferential direction, while the toner farther away from the stirring roller 23 and the conveying spiral 24 is pushed towards the inner wall of the black developing container 20*d*. Therefore, the toner remains in the dead space of the black developing container 20*d*, and the old toner stored in the developing container 20*d* cannot be completely removed even when an operation is performed to replace the old toner stored in the black developing container 20*d* with new toner.

In view of this, the above-described one-sided printing mode and the two-sided printing mode are complemented in the printer A by a toner ejection mode to remove completely the toner stored in the black developing container 20*d*. The toner is removed by rotating the rotary developing unit 13 at a specific timing. The removal is accomplished using gravity as well as the centrifugal force that acts on the toner stored in the black developing container 20*d* due to this rotation, or using the vibration that acts on the black developing container 20*d* when the rotation is stopped.

In view of this, the toner ejection mode can be set by operating a button, a display screen (neither are shown), or other component installed in the printer A and used to set the functions of the printer A. Consequently, after the trial printing of the manufactured printer A has ended, the toner ejection mode is implemented by operating the button, display screen, or other component installed in the printer A when the printer A is shipped from the factory.

Referring to FIG. 4, data on the amount of toner that will be consumed until the toner ejection mode is implemented are stored in advance in the memory 72. The consumption of black toner per printed sheet of recording paper is totaled and stored in the memory 72 as described above. In the printer A, the toner ejection mode is implemented when the toner consumption, as calculated per printed sheet of recording paper and totaled and stored in the memory 72, is equal to the toner consumption that is needed to complete the toner ejection mode extra space and is stored in advance in the memory 72.

The image data remaining until the toner ejection mode is complete cannot be printed during the processing of the image data sent from a terminal device connected to the printer A. In other words, the remaining data cannot be printed when the toner ejection mode is implemented before printing of the image data is completed. In printer A, therefore, the control unit 71 checks whether the image data are being processed when the conditions to implement the toner ejection mode are fulfilled, whereupon the toner ejection mode is implemented after all of the image data have been processed.

In the printer A thus configured, image data are entered from the terminal devices connected to the printer A by means of a communication network. When a command is issued to begin printing, power is supplied by the power supply unit 70 to all the units in the printer A, and the operation of the units in the printer A is controlled on the basis of control signals entered by the control unit 71. Consequently, in the printer A shown in FIG. 1, the steps of charging, light exposure, development, primary transfer, secondary transfer, and fixing are performed in the listed sequence. A description is given below in the order of one-sided printing mode, two-sided printing mode, and toner ejection mode.

First, when the printing operation is performed in the one-sided printing mode, the recording paper fed from the paper supply cassette 52 by the rotation of the paper supply roller 53 is conveyed to the conveyance roller 59 and passed through the curved path 61 of the first conveyance path 54. The recording paper that has passed through the curved path 61 of the first conveyance path 54 is conveyed through the straight path 62 of the first conveyance path 54 to the pair of resist rollers 60. The orientation of the recording paper is corrected by the resist rollers 60, the timing is adjusted, and the paper is then conveyed to the nipping part between the drive roller 39 and the secondary transfer roller 41.

When the recording paper is thus conveyed to the nipping part between the drive roller 39 and the secondary transfer roller 41, the surface of the photoreceptor drum 10 is first positively charged by an electric discharge from the charging roller 11 in the charging step. In the next light exposure step, the photoreceptor drum 10 is irradiated by laser light from a semiconductor laser (not shown) of the light exposure unit 12, and the laser light reflected at a specific angle by the reflective mirror 18 scans the top of the photoreceptor drum 10. The portion of the surface of the photoreceptor drum 10 that is exposed to the laser light acquires a lower voltage, and an electrostatic latent image is formed on this portion.

Referring now to FIGS. 1 and 2, when a positive voltage is applied to the developing rollers 21 of the developing containers 20 in the rotary developing unit 13 in the development step, an electrostatic force is created according to the potential difference between the positively charged toner adhered to the surface of the developing roller 21 and the portion of the surface of the photoreceptor drum 10 on which the electrostatic latent image is formed. The image is developed by the supply of the toner from the developing roller 21 to the portion of the surface of the photoreceptor drum 10 on which the electrostatic latent image is formed.

In the next primary transfer step, the image formed on the surface of the photoreceptor drum 10 is transferred to the surface of the intermediate transfer panel 37, which is driven at a specific speed. At this time, the image formed on the surface of the photoreceptor drum 10 is superposed and transferred onto the surface of the intermediate transfer panel 37 at a specific timing interval for each toner color, and an image composed of multiple colors is formed on the surface of the intermediate transfer panel 37.

After the first primary transfer step has ended, the toner deposit adhered to the surface of the photoreceptor drum 10 is scraped off from the surface of the photoreceptor drum 10 by polishing the surface of the photoreceptor drum 10 with the polishing roller 35 of the drum-cleaning unit 17, and the deposit is then recovered in the recovery unit (not shown) by the recovery spiral 36.

In the next secondary transfer step, when a negative voltage is applied to the secondary transfer roller 41, an electrostatic force is created according to the potential difference between the positively charged toner adhered to the surface of the intermediate transfer panel 37 and the secondary transfer roller 41, and the image formed on the surface of the intermediate transfer panel 37 is transferred to the recording paper that is passing through the nipping part between the drive roller 39 and the secondary transfer roller 41. The recording paper onto which the image has been transferred in the secondary transfer step is then passed through the second conveyance path 55 and is conveyed towards the nipping part between the fixing roller 32 and the pressure roller 34 in the fixing unit 16.

After the secondary transfer step has ended, the toner deposit adhered to the surface of the intermediate transfer panel 37 is scraped off by the brush roller 44 of the belt-cleaning unit 42, and the deposit adheres to the surface of the cleaning roller 45. The deposit from the intermediate transfer panel 37 that has adhered to the surface of the cleaning roller 45 is then scraped off from the surface of the cleaning roller 45 by the blade 46, and is recovered in the recovery unit (not shown) by the recovery spiral 47.

Referring now to FIGS. 1, 2, and 4, a control signal that turns on the power source of the fixation heater 33 is sent to the power supply unit 70 by the control unit 71, which initiates the supply of power from the power supply unit 70 to the fixation heater 33 and heats the fixation heater 33. The fixing roller 32 is heated by the fixation heater 33 to a temperature at which the toner can be stably fixed to the recording paper. In the fixation step, the toner on the recording paper is melted by the heat from the fixing roller 32 as the paper passes through the nipping part between the fixing roller 32 and the pressure roller 34 in the fixing unit 16, and pressure is applied to the recording paper by the pressure roller 34, causing the toner to be fixed on the recording paper. The recording paper on which the toner is fixed in the fixation step passes through both the third conveyance path 56 and the position of the branching pawl 57, and is then conveyed to the outside of the printer A and ejected into the paper ejection unit 50.

Next, when the printing operation is performed in the two-sided printing mode, the one-side printed recording paper to which toner has been fixed in the fixation step is passed through the position of the branching pawl 57, and is then conveyed to the return conveyance path 58 by the branching pawl 57. The one-side printed recording paper conveyed to the return conveyance path 58 is conveyed through the return conveyance path 58 to the straight path 62 of the first conveyance path 54. The orientation of the paper is corrected and the conveyance timing is adjusted in the pair of resist rollers 60, and the paper is conveyed to the nipping part between the drive roller 39 and the secondary transfer roller 41.

After one side of the recording paper has been used to print, an image is printed on the other side by performing the same printing operation as in the one-sided printing mode. The recording paper, having images thus printed on both sides, is then passed through the position of the branching pawl 57 and is fed to the outside of the printer A and ejected into the paper ejection unit 50.

When toner is supplied to the developing containers 20 of the rotary developing unit 13, the printing operation of the one-sided printing mode or the two-sided printing mode is stopped, and the rotary developing unit 13 is then rotated to move the developing container 20 to a specific position to be supplied with the toner. As seen in FIGS. 1 and 3, when the motor is driven in this state, the pinion gear 31 rotates, and the toner supply pipe 25 attached to the rack 30 meshed with the pinion gear 31 is moved from the retracted position shown by the solid lines in FIG. 1 to the supply position shown by the dashed lines in FIG. 1. The bottom end of the toner supply pipe 25 passes through the slit formed in the developing container 20 to be supplied with toner, and enters the developing container 20.

The coil spring 29 attached to the inside of the conveying pipe 26 then rotates, conveying the toner stored in the toner cartridge of the toner storage part 14 through the conveying pipe 26 to the toner supply pipe 25. The spiral member 28 attached to the inside of the toner supply pipe 25 also rotates, whereby the toner conveyed to the toner supply pipe 25 is moved to the bottom of the toner supply pipe 25 and is supplied from the bottom end of the toner supply pipe 25 to the developing container 20 that is to be supplied with toner.

Furthermore, the toner ejection mode is also implemented in this printer A in addition to the one-sided printing mode and the two-sided printing mode. The toner ejection mode will be described with reference to the flowchart shown in FIG. 5.

Figure 5:
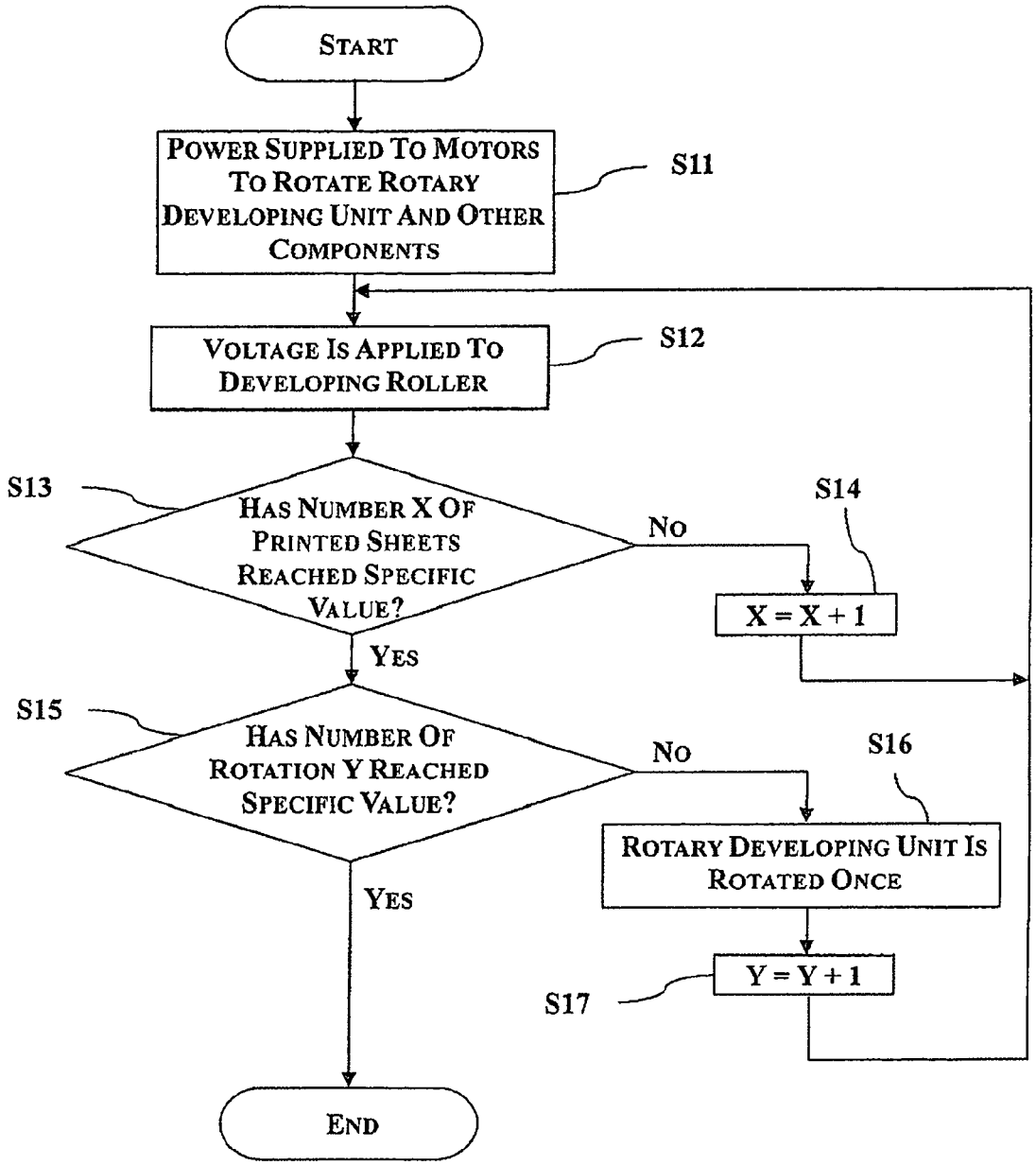
FIG. 5 is a view of a flowchart showing the operation of a control unit of the printer of FIG. 1 in a toner ejection mode.

Specifically, referring to FIGS. 4 and 5, when the toner ejection mode is implemented with the timing described above, power is supplied by the power supply unit 70 to a motor (not shown) to rotate the drive roller 39, the primary transfer roller 40, the secondary transfer roller 41, and other rollers, and also to rotate the photoreceptor drum 10, the rotary developing unit 13, and the like (step S11). Power is also supplied by the power supply unit 70 to the belt-cleaning unit 42.

At this point, the rotary developing unit 13 rotates, and the rotary developing unit 13 stops at the same position as when black toner is made to adhere to the surface of the photoreceptor drum 10 in the one-sided printing mode or the two-sided printing mode. Specifically, the rotary developing unit 13 stops at the point at which the developing roller 21 of the black developing container 20*d* in the rotary developing unit 13 reaches a position facing the photoreceptor drum 10.

Referring now to FIGS. 2, 4, and 5, the control unit 71 then instructs the power supply unit 70 to apply a positive voltage to the developing roller 21 of the black developing container 20*d*, whereby the positively charged toner is caused to adhere to the surface of the developing roller 21 (step S12). In the toner ejection mode, the supply of power to the charging roller 11 is halted. Therefore, the charging roller 11 is not electrically discharged and the surface of the photoreceptor drum 10 is not electrically charged. Consequently, an electrostatic force is created according to the difference in potential between the positively charged toner adhering to the surface of the developing roller 21 and the entire surface of the photoreceptor drum 10, toner is supplied to the entire surface of the photoreceptor drum 10 by the developing roller 21, and the toner thereby adheres to the entire surface of the photoreceptor drum 10.

The image designed for a single sheet of recording paper and formed on the surface of the photoreceptor drum 10 is then transferred to the surface of the intermediate transfer panel 37, which is driven at a specific speed. In the toner ejection mode, a positive voltage, which has the opposite polarity in relation to that of the printing operation in the one-sided printing mode and the two-sided printing mode, is applied to the secondary transfer roller 41. Consequently, when the portion of the surface of the intermediate transfer panel 37 onto which an image is transferred passes through the secondary transfer roller 41, the toner adhered to the surface of the intermediate transfer panel 37 is prevented from being transferred to the secondary transfer roller 41.

When the portion of the surface of the intermediate transfer panel 37 onto which the image is transferred reaches the belt-cleaning unit 42, the toner constituting the image formed on the surface of the intermediate transfer panel 37 is scraped off by the brush roller 44 and is made to adhere to the surface of the cleaning roller 45. The deposit from the intermediate transfer panel 37 that has adhered to the surface of the cleaning roller 45 is scraped off from the surface of the cleaning roller 45 by the blade 46, and is recovered in the recovery unit (not shown) by the recovery spiral 47.

Thus, the toner is ejected from the black developing container 20*d* of the rotary developing unit 13, and an image for one sheet of recording paper is formed on the surface of the photoreceptor drum 10. The image formed on the surface of the photoreceptor drum 10 is then transferred to the surface of the intermediate transfer panel 37, and the toner adhered to the surface of the intermediate transfer panel 37 is recovered by the belt-cleaning unit 42.

The control unit 71 then determines whether or not the number X of printed sheets of recording paper as counted by the counter has reached a specific value (step S13). Specifically, the control unit 71 determines whether or not images proportionate to a specific number of sheets have been transferred onto the surface of the intermediate transfer panel 37 by the photoreceptor drum 10. If the control unit 71 confirms that the number X of printed sheets of recording paper counted by the counter has not reached a specific value at this time (No in step S13), then the counter value is increased by 1 (step S14), the process returns to step S12, and an operation is performed to cause the toner stored in the black developing container 20*d* to adhere to the surface of the photoreceptor drum 10.

The operation to cause the toner stored in the black developing container 20*d* to adhere to the surface of the photoreceptor drum 10 is thus repeated. If the control unit 71 then confirms that the number X of printed sheets of recording paper counted by the counter has reached a specific value (Yes in step S13), then the control unit 71 determines whether or not the number of rotations Y of the rotary developing unit 13 as counted by the counter has reached a specific value (step S15). When the process has reached step S15, the number X of printed sheets of recording paper as counted by the counter is reset to zero.

In step S15, if the control unit 71 confirms that the number of rotations Y of the rotary developing unit 13 as counted by the counter has not reached a specific value (No in step S15), then the rotary developing unit 13 is rotated once (step S16), the rotary developing unit 13 is stopped at the same position as when black toner is made to adhere to the surface of the photoreceptor drum 10 in the one-sided printing mode or the two-sided printing mode, and the counted value is increased by 1 (step S17). The process then returns to step S12, and an operation is performed to cause the toner stored inside the black developing container 20*d* to adhere to the surface of the photoreceptor drum 10.

Rotating the rotary developing unit 13 causes gravity or centrifugal force to act on the toner stored inside the black developing container 20*d*, and causes vibrations to act on the black developing container 20*d* when the rotation of the rotary developing unit 13 is halted. The toner remaining in the dead space of the developing container 20*d* as a result of being pushed to the inner wall of the black developing container 20*d* during the printing operation is consequently removed from the developing container 20*d*. The toner can be more reliably removed from the black developing container 20*d* if the number of rotations of the rotary developing unit 13 in step S16 is set to two or greater.

An operation is thus repeated in which the toner stored in the black developing container 20*d* proportionate to a specific number of sheets for each rotation of the rotary developing unit 13 is made to adhere to the surface of the photoreceptor drum 10. The toner ejection mode is then ended when the control unit 71 confirms that the number of rotations Y of the rotary developing unit 13 as counted by the counter has reached a specific value (Yes in step S15).

According to present embodiment, rotating the rotary developing unit 13 in the toner ejection mode makes it possible to use the gravity and centrifugal force acting on the black toner stored in the black developing container 20*d* or to use the vibrations acting on the black developing container 20*d* when the rotary developing unit 13 stops rotating, and to remove completely the toner remaining in the dead space of the black developing container 20*d* from the developing container 20*d*. Consequently, the operation of attaching and removing the rotary developing unit 13 following an image check can be omitted when the manufactured printer A is shipped, and the service life of the black toner stored in the black developing container 20*d* can be increased.

Image quality is commonly reduced more rapidly by toner degradation or changes in the particle size distribution of the toner with a reduction in the capacity of the toner-storing portion of the black developing container 20*d*. In the present embodiment, however, the service life of the black toner stored in the black developing container 20*d* can be increased. Therefore, the capacity of the toner-storing portion in the black developing container 20*d* can be reduced when the goal is to maintain the same service life as in conventional practice, and the rotary developing unit 13 can be reduced in size.

In this printer A, a determination is made as to whether the number X of printed sheets of recording paper has reached a specific value in step S13 in the flowchart shown in FIG. 5, but the present invention is not limited to this option alone. Specifically, when images are continuously formed on the surface of the photoreceptor drum 10 instead of being formed on the surface of the photoreceptor drum 10 for each sheet of recording paper, either the time elapsed after the rotary developing unit 13 begins to be driven or the time elapsed after voltage is applied to the developing roller 21 of the black developing container 20*d* may be measured, and a determination may be made as to whether either of these elapsed times has reached a specific value in step S13.

In this printer A, the control unit 71 determines whether or not the number of rotations Y of the rotary developing unit 13 as counted by the counter has reached a specific value in step S15 of the flowchart shown in FIG. 5, but the present invention is not limited to this option alone. Specifically, when a concentration sensor (not shown) to measure the image concentration on the surface of the intermediate transfer panel 37 is installed in the printer A, the concentration of the images transferred onto the surface of the intermediate transfer panel 37 by the photoreceptor drum 10 is measured by the concentration sensor. The control unit 71 shown in FIG. 4 may then determine that the toner stored in the black developing container 20*d* has been completely removed, and the toner ejection mode may be ended when the value measured by the concentration sensor is confirmed to have reached a specific value or less.

In this printer A, power is not supplied to the charging roller 11 in the toner ejection mode, but the printer may be designed so that power is supplied to the charging roller 11. At this time, laser light is directed by the light exposure unit 12 onto the electrically charged photoreceptor drum 10, and the toner stored in the black developing container 20*d* is made to adhere to the surface of the photoreceptor drum 10, whereby the toner is ejected from the black developing container 20*d*.

In this printer A, the image formed on the surface of the photoreceptor drum 10 is transferred to the surface of the intermediate transfer panel 37, and the toner constituting the image formed on the surface of the intermediate transfer panel 37 is recovered by the belt-cleaning unit 42 in the toner ejection mode, but the present invention is not limited to this option alone. Specifically, the toner constituting the image formed on the surface of the photoreceptor drum 10 may be recovered by the drum-cleaning unit 17 in the toner ejection mode.

In this printer A, the timing with which the toner ejection mode is implemented is determined based on the number of black toner dots calculated by analyzing the image data sent from the terminal devices connected to the printer A, but the present invention is not limited to this option alone. Specifically, in this printer A, the timing with which the toner ejection mode is implemented may be determined based either on the number of printed sheets of recording paper when monochrome images are outputted using black toner, or on the number of times the black toner cartridge mounted on the toner storage part 14 is replaced.

The imaging apparatus of the present invention can be described as follows.

Specifically, the imaging apparatus of the present embodiment includes a rotary developing unit composed of multiple developing containers that are disposed along the circumferential direction and that correspond to toner colors, wherein images are developed by rotating the rotary developing unit to cause the toner to be supplied to electrostatic latent images formed on the surface of a photoreceptor drum from the developing containers that have moved to positions facing the photoreceptor drum. The imaging apparatus also includes a toner ejection mode whereby a single magnetic toner component stored in a black developing container to store black toner is removed from the black developing container, which is one of a plurality developing containers. When the toner ejection mode is implemented, the black developing container can be moved to a position facing the photoreceptor drum, black toner can be supplied to the surface of the photoreceptor drum, and the rotary developing unit can be rotated at a specific timing interval.

In this imaging apparatus, rotating the rotary developing unit in the toner ejection mode makes it possible to use the gravity and centrifugal force acting on the black toner stored in the black developing container or to use the vibrations acting on the black developing container when the rotary developing unit stops rotating, and to remove completely the toner remaining in the dead space of the black developing container from the developing container. Consequently, the operation of attaching and removing the rotary developing unit following an image check can be omitted when the manufactured printer is shipped, and the service life of the black toner stored in the black developing container can be increased.

Image quality is commonly reduced more rapidly by toner degradation or changes in the particle size distribution of the toner with a reduction in the capacity of the toner-storing portion of the black developing container. In the present invention, however, the service life of the black toner stored in the black developing container can be increased. Therefore, the capacity of the toner-storing portion in the black developing container can be reduced when the goal is to maintain the same service life as in conventional practice, and the rotary developing unit can be reduced in size.

The imaging apparatus may be designed so that a drum-cleaning unit is included that is provided with a drum-cleaning member to remove toner adhered to the surface of the photoreceptor drum, and the toner adhered to the surface of the photoreceptor drum is recovered in the drum-cleaning unit when the toner ejection mode is implemented.

The surface of the photoreceptor drum may be formed from amorphous silicon, for example. The present invention may also be designed so that the black toner ejected from the black developing container is recovered together with part of the surface of the photoreceptor drum into the drum-cleaning unit in the toner ejection mode.

The imaging apparatus also includes an intermediate transfer belt onto which images formed on the surface of the photoreceptor drum are transferred, and a belt-cleaning unit provided with a belt-cleaning member to remove the toner adhered to the surface of the intermediate transfer belt. The imaging apparatus may be designed so that when the toner ejection mode is implemented, the images formed on the surface of the photoreceptor drum are transferred to the surface of the intermediate transfer belt, and the toner adhered to the surface of the intermediate transfer belt is recovered in the belt-cleaning unit.

Thus, in the toner ejection mode, images formed on the surface of the photoreceptor drum are transferred to the intermediate transfer belt, whereby the toner adhered to the surface of the intermediate transfer belt is recovered in the belt-cleaning unit.

In each of the imaging apparatuses described above, images formed on the surface of the photoreceptor drum are printed on the recording paper, whereby the images printed on recording paper can be checked when the manufactured imaging apparatus is being shipped, and the toner ejection mode may be implemented after the images printed on the recording paper are checked.

After the imaging apparatus is manufactured in a factory, a trial printing is performed as an operation check before the imaging apparatus is shipped. At this time, toner is stored in the black developing container of the rotary developing unit for the trial printing. After the trial printing has ended, the toner ejection mode is implemented in a stage in which the imaging apparatus is being shipped, and the toner is removed from the black developing container. The toner can thereby be prevented from scattering to the outside of the black developing container due to vibrations while the imaging apparatus is being transported, and the operation of attaching and removing the rotary developing unit following an image check can be omitted.

In each of the imaging apparatuses described above, the toner ejection mode may be implemented at a specific timing interval after the shipped imaging apparatus is first used.

Implementing the toner ejection mode in this manner at a specific timing interval after the shipped imaging apparatus is first used makes it possible to prevent reliably reduction in image quality due to changes in the particle size distribution or degradation of the toner stored in the black developing container. Since the toner stored in the black developing container is reliably removed in the toner ejection mode, the service life of the toner subsequently stored in the black developing container can be increased, and the toner ejection mode can be implemented less frequently.

This imaging apparatus includes memory to store data. The toner consumption, as calculated based on the number for black toner dots used to print an image on the recording paper, can be totaled and stored in the memory each time a sheet of recording paper is printed; the amount of toner that will be consumed until the toner ejection mode is implemented can be stored in advance; and the specific timing interval can be considered to be achieved when the toner consumption totaled and stored in the memory is equal to the memory-prestored toner consumption needed to complete the toner ejection mode. Another option aside from the one described above is for the specific timing interval to be determined based on either the number of printed sheets of recording paper when monochrome images are outputted using black toner, or the number of times the toner cartridge corresponding to the black toner is replaced from among the plurality of toner cartridges to supply toner to the developing containers mounted in the imaging apparatus. In other words, this imaging apparatus includes memory to store data. The toner consumption, as calculated based on the number for black toner dots used to print an image on the recording paper, can be totaled and stored in the memory each time a sheet of recording paper is printed; and the specific timing interval is the time taken for the toner consumption totaled and stored in said memory to equal a prescribed value stored in the memory.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An imaging apparatus comprising:

a photoreceptor drum being configured to support electrostatic latent images;

a plurality of developing containers being configured to store a toner in interiors thereof and being configured to develop the electrostatic latent images by supplying said toner onto said photoreceptor drum;

a rotating unit being configured to place said developing containers in positions facing said photoreceptor drum by holding and rotating said developing containers;

a printing mode being configured to rotate said rotating unit when a command is issued to begin printing and to supply said toner inside at least one of said developing containers to the surface of said photoreceptor drum at a position facing said photoreceptor drum following rotating said rotating unit; and a toner ejection mode being configured to rotate completely said rotating unit at least twice with a specific timing while images are not being formed and to supply said toner inside at least one of said developing containers to the surface of said photoreceptor drum while images are not being formed following rotating said rotating unit.

2. The imaging apparatus according to claim 1, further comprising a drum-cleaning unit on which is provided with a drum-cleaning member to remove toner that has adhered to the surface of said photoreceptor drum, wherein toner that has adhered to the surface of said photoreceptor drum is recovered by said drum-cleaning unit when said toner ejection mode is implemented.

3. The imaging apparatus according to claim 1, further comprising an intermediate transfer belt onto which images formed on the surface of said photoreceptor drum are transferred, and a belt-cleaning unit provided with a belt-cleaning member to remove toner that has adhered to the surface of said intermediate transfer belt, wherein the images formed on the surface of said photoreceptor drum are transferred onto the surface of said intermediate transfer belt, and the toner that has adhered to the surface of said intermediate transfer belt is recovered by said belt-cleaning unit when said toner ejection mode is implemented.

4. The imaging apparatus according to claim 1, wherein said toner ejection mode is implemented before the imaging apparatus is shipped, and after the images formed on the surface of said photoreceptor drum are trial-printed on recording paper and the images printed by said trial printing are checked.

5. The imaging apparatus according to claim 1, wherein said toner ejection mode is implemented at a specific timing interval after the shipped imaging apparatus is first used.

6. The imaging apparatus according to claim 5, further comprising memory to store data, wherein toner consumption calculated from the number of toner dots used to print images on recording paper is totaled and stored in said memory each time a sheet of recording paper is printed, and said memory stores in advance data regarding the amount of toner that will be consumed until said toner ejection mode is implemented, and said specific timing interval is the time taken for the toner consumption totaled and stored in said memory to equal the memory-prestored toner consumption needed to complete said toner ejection mode.

7. A method for operating an imaging apparatus comprising:

configuring a photoreceptor drum to support electrostatic latent images;

configuring a plurality of developing containers to store a toner in interiors thereof and to develop the electrostatic latent images by supplying said toner onto said photoreceptor drum;

arranging a rotating unit to place said developing containers in positions facing said photoreceptor drum by holding and rotating said developing containers;

implementing a printing mode including rotating said rotating unit when a command is issued to begin printing, and supplying said toner inside at least one of said developing containers to the surface of said photoreceptor drum at a position facing said photoreceptor drum following rotating said rotating unit when a command is issued to begin printing; and implementing a toner ejection mode including rotating completely and at least twice said rotating unit with a specific timing while images are not being formed, and supplying said toner inside of at least one of said developing containers to the surface of said photoreceptor drum at a position facing said photoreceptor drum while images are not being formed following rotating said rotating unit.

8. The method according to claim 7, further comprising removing toner that has adhered to the surface of said photoreceptor drum, and recovering toner that has adhered to the surface of said photoreceptor drum.

9. The method according to claim 7, further comprising transferring toner onto an intermediate transfer belt from the surface of said photoreceptor drum, removing toner that has adhered to the surface of said intermediate transfer belt, and implementing said ejection mode to include transferring toner on the surface of said photoreceptor drum onto the surface of said intermediate transfer belt, and recovering the toner from said intermediate transfer belt.

10. The method according to claim 7, further comprising implementing said toner ejection mode before the imaging apparatus is shipped and after the images formed on the surface of said photoreceptor drum are trial-printed on recording paper and the images printed by said trial printing are checked.

11. The method according to claim 7, further comprising implementing said toner ejection mode at a specific timing interval after the shipped imaging apparatus is first used.

12. The method according to claim 5, further comprising configuring memory to store data, and calculating toner consumption from the number of toner dots used to print images on recording paper, totaling and storing in said the toner consumption each time a sheet of recording paper is printed, and storing in advance in said memory data regarding the amount of toner that will be consumed until implementing said toner ejection mode, and arranging said specific timing interval to be the time taken for the toner consumption totaled and stored in said memory to equal the memory-prestored toner consumption needed to complete said toner ejection mode.

13. The imaging apparatus according to claim 1, wherein said toner ejection mode is implemented after a predetermined number of sheets are printed.

14. The method according to claim 7, wherein implementing said toner ejection mode occurs after a predetermined number of sheets have been printed.

* * * * *